US006311744B1

(12) United States Patent
Cary

(10) Patent No.: US 6,311,744 B1
(45) Date of Patent: Nov. 6, 2001

(54) HOSE FITTING FOR FILLING TANK CARS AND METHOD OF SAME

(76) Inventor: Chester Cary, 7155 Heron, Houston, TX (US) 77087

( * ) Notice: Subject to any disclaimer, the term of this patent is extended or adjusted under 35 U.S.C. 154(b) by 0 days.

(21) Appl. No.: 09/583,676

(22) Filed: May 31, 2000

(51) Int. Cl.[7] ..... B65B 1/04

(52) U.S. Cl. ..... 141/286; 141/382; 141/383; 137/561 A; 137/592; 414/293; 414/299

(58) Field of Search ..... 141/286, 382, 141/383, 387, 388; 137/561 A, 590, 592; 414/293, 299, 301, 302

(56) References Cited

U.S. PATENT DOCUMENTS

| | | | | |
|---|---|---|---|---|
| 619,437 | | 2/1899 | Pool . | |
| 2,396,163 | | 3/1946 | Dies | 285/196 |
| 3,381,982 | | 5/1968 | Elek | 285/156 |
| 3,486,771 | | 12/1969 | Conlin | 285/39 |
| 4,040,529 | * | 8/1977 | Wurdeman et al. | 414/301 |
| 4,648,628 | | 3/1987 | Meadows et al. | 285/24 |
| 4,722,555 | | 2/1988 | Soulatis | 285/5 |
| 4,930,816 | | 6/1990 | Biing-Yih | 285/321 |
| 5,065,781 | | 11/1991 | Cox | 137/15 |
| 5,104,150 | | 4/1992 | Bard et al. | 285/12 |
| 5,131,697 | | 7/1992 | Shumway | 285/404 |
| 5,681,058 | | 10/1997 | Hwang | 285/39 |
| 5,746,258 | * | 5/1998 | Huck | 141/286 |
| 5,836,362 | * | 11/1998 | Ackley et al. | 141/286 |
| 5,927,762 | | 7/1999 | Webb | 285/123.15 |
| 5,950,694 | * | 9/1999 | Jama et al. | 141/286 |
| 6,058,968 | * | 5/2000 | Carter | 137/561 A |

* cited by examiner

*Primary Examiner*—J. Casimer Jacyna
(74) *Attorney, Agent, or Firm*—Jo Katherine D'Ambrosio

(57) ABSTRACT

A hose fitting for filling tank cars comprising a t-shaped pipe defining a bore therethrough, the t-shaped pipe comprising a body member with one or more pairs of opposingly directed tubular legs, and an intermediate leg extending substantially perpendicular from the body member, the intermediate leg comprising an intermediate leg end adapted to couple with a hose; and one or more tube extensions for coupling with the tubular legs, each of the one or more tube extensions connected to one of the tubular legs by a connecting wire so that the tube extensions remain connected to the tubular legs when the tube extensions are uncoupled from the tubular legs.

A method for filling tank cars with pellet-shaped particles is also provided, the method comprising transporting the t-shaped pipe to the roof of a tank car, the tank car roof having one or more openings for receiving materials. The method further comprising transporting a hose to the top of the tank car, the hose adapted to conduct pellet-like particles under pressure. The hose is then connected to the t-shaped pipe to form a hose fitting and connected to the truck tank. The t-shaped pipe is introduced into an opening in the roof of the tank car and positioned inside the tank of the tank car approximately adjacent the roof of the tank car. The pellet-like particles are pumped from the truck through hose, through the bores of the t-shaped pipe and into tank car to fill the tank car.

18 Claims, 4 Drawing Sheets

HOSE FITTING FOR FILLING TANK CARS AND METHOD OF SAME

FIELD OF THE INVENTION

The present invention relates to a hose fitting and method for filling tank cars. More particularly, the present invention relates to a hose fitting and method for filling railroad and truck tank cars with pellet-like or powdery materials.

BACKGROUND

Transferring materials from a one tank to another by hose is a cumbersome and time-consuming chore. This is especially true of the process of filling railroad tank cars with pellet-like materials. Pellet-like materials such as plastic pellets are lightweight and tend to fly about. Railroad tank cars for carrying pellet-like particles typically have a rectangular configuration with a v-shaped bottom. The top of the tank car has two or three hatched openings for loading the tank car and an opening in the v-shaped bottom for unloading. Materials for loading the tank cars are often transported to the tank cars by truck. The driver of the truck must transfer the load to the tank car by means of a high-pressure hose. A truck compressor is used to blow the pellets out of the truck, though the hose and into the tank car. This can be difficult. High-pressure hoses are heavy. One end of the hose is brought up to the roof of the tank car and inserted into one of the hatched openings as illustrated in prior art FIGS. 1 and 2. Because the hatched openings B, B' are off center, if the hose A empties into one hatched opening B, pile ups F occur and the tank car fills unevenly. A string or rope E is attached to the end of the hose and the truck driver attempts to catch the rope E through the other hatched opening B' after the hose E is inserted to centered the hose. Even with the hose somewhat centered, an uneven mound F forms so that the sides D of the railroad tank are not utilized and thereby leaving unfilled spaces within the tank car.

As the pile of lightweight pellets approach the top of the of the railroad tank in uneven mounds, the pellets, under pressure, tend to fly out of the openings and scatter into the surrounding environs. Pellets flying out of the tank car can be dangerous to the loader of the tank car who can slip and fall. Also this loss of pellets is a financial loss as well as an environmental problem. The scattering of pellets is especially dangerous if the pellets are hazardous materials.

T-type couplers are well known. Cox, in U.S. Pat. No. 5,065,781, discloses a apparatus for removing density materials from the bottom of an oil storage tank that provides an extended bottom hose with multiple openings. The hose lies on the bottom of the tank. Reference 5,065,781 discloses attaching a rope to the free end of a bottom hose and lowering the T-coupling until it is inside the tank, recovering the free end and attaching it to T-coupling. The bottom hose is attached to a riser through which liquid is removed from the tank.

Soultatis, in U.S. Pat. No. 4,722,555, discloses a quick connect coupling having heads unified with a pipe. It is a quick connect pressurized coupling assembly having mating male and female headboards, each attached to an outwardly flared pipe end. The Soultatis device uses two hooks adapted for attachment to the male part of the coupling device providing male and female head parts to be connected together to provide a pressurized joint for pipes.

Shumway, U.S. Pat. No. 5,131,697, discloses a pipe and coupling system that is fabricated for use in conjunction with a locking pin type readless couplings, the pipe has a thin wall configuration achieved by fabricating it from high tense steel.

Meadows et al., U.S. Pat. No. 4,648,628, discloses a branch hose constructing and T-connector used in methods of making the hose construction with T-connector. The branched hose construction comprises a T-connector having a body portion provided with a pair of substantially oppositely directed legs extending outward.

Bard et al., U.S. Pat. No. 5,104,150, discloses a multiple purpose irrigation fitting. The fitting comprises tee shaped fitting for connecting porous and non-porous irrigation tubing. The tee shaped fitting is also connected to garden hoses with three openings and includes caps. The fitting is collapsible at one or more openings with caps so that one fitting can be used as a elbow, coupling, tee, or end cap, thus avoiding the purchase of many different kinds of fittings. None of the above-referenced patents disclose a hose fitting that facilitates the loading of pellet-like particles in tank cars.

What is needed is a hose fitting that is easy to insert into the top of the tank and loads the tank car evenly, without pellets flying out to pollute the environment.

SUMMARY

The present invention relates to a hose fitting for filling tank cars that facilitates the insertion of the hose into the top of the tank car and disperses the material, pellet-like particles for example, evenly throughout the tank car thereby avoiding mounding and empty spaces. Advantageously, the hose fitting of the present invention stops the high pressure filling action when the pellet-like particles reach the top of the go hose fitting so that pellets are not lost to the environment.

A preferred embodiment of a hose fitting for filling tank cars comprises a t-shaped pipe defining a bore throughout coupled with a hose adapted to disperse pellet-like particles under pressure. Preferably, the t-shaped pipe comprises a body member with one or more pairs of opposingly directed legs, and an intermediate leg extending substantially perpendicular from the body member. The intermediate leg preferably has an end referred to as an intermediate end opposite the body. The intermediate end is adapted to couple with an end of the hose. Preferably, the hose comprises a truck end and a t-shaped pipe end so that the intermediate end of the t-shaped pipe is adapted to couple with the tshaped pipe end of the hose.

In one aspect, each of the one or more pairs of legs can comprise a first leg and a second leg, the first leg having a first end, the second leg having a second end. The first end and the second end are adapted to couple with one or more tube extensions. Tube extensions allow the hose fitting to be easily inserted into openings in the roof of the tank car when the tube extensions are uncoupled from the t-shape pipe. The tube extensions help to prevent the hose fitting from slipping out of the top opening in the tank car as well as improve the filling action so that the pellets fill the tank car substantially without mounding.

In one embodiment, a first tube extension is detachably coupled to the first end of the first leg and a second tube extension is detachably coupled to the second end of the second leg so that a fluid conduit is formed therethrough. In another aspect, the first extension is connected to the first end by a first connecting wire and a second extension is connected to the second end by a second connecting wire, so that the first extension and the second extension remain attached to the body member by the first and second wires when the first extension is uncoupled from the first end and the second extension is uncoupled from the second end. This facilitates carrying the hose fitting to and from roof of the tank car as well as preventing loss of the extensions.

In a more preferred embodiment, the body member further comprises a cone-shape projection extending into the bore opposite the intermediate leg so that pellets are dispersed to evenly to the first and second legs of the t-shaped pipe.

Another embodiment of this invention is a method for filling tank cars with pellet-shaped particles or other materials. The method comprises transporting a t-shaped pipe to the roof of a tank car, the tank car roof having one or more openings for receiving materials. In one preferred method, the t-shaped pipe comprises a body member with one or more pairs of opposingly directed tubular legs, each pair of opposingly directed legs comprising a first leg and a second leg extending therefrom and the body member and tubular legs comprising a first bore extending therethrough. Preferably, the body member further comprises an intermediate leg extending substantially perpendicular from the body member, the intermediate leg defining a second bore in fluid communication with the first bore. In another step of the preferred method, a hose is transported to the top of the tank car; the hose can be adapted to conduct pellet-like particles under pressure. Preferably, the hose comprises a truck end for coupling the hose to the truck and a t-shaped pipe end for connecting to the t-shaped pipe. The t-shaped pipe end of the hose can be coupled with the intermediate leg of the t-shaped pipe to form a hose fitting. The hose fitting is connected to the truck when the truck end of the hose is coupled with the truck tank. In one preferred embodiment one or more extensions for coupling with the tubular legs can be connected to the tubular legs by a connecting wire so that the tube extensions remain connected to the tubular legs when the tube extensions are uncoupled.

The t-shaped pipe with one of the connected tube extensions coupled with a tubular leg is introduced into an opening in the roof of the tank car. The t-shaped pipe can be positioned inside the tank approximately adjacent the roof of the tank car. A second tube extension is then coupled with a second tubular leg so that the length of the t-shaped pipe is increased. The pellet-like particles are pumped by a high compression engine from the truck through hose, through the bores of the extended t-shaped pipe and into tank car. Because the tubular legs of the t-shaped pipe are extended, the pellets tend to hit the sides of the tank car. This action results in a more evenly distribution of pellets within the tank car so that it fills up without uneven mounding. The pumping action substantially ceases however, when the pellet-like particles reach the top of the intermediate and t-shaped bores and the tank car is filled.

BRIEF DESCRIPTION OF DRAWINGS

Prior art FIG. 1 sectional view of a tank car with a hose for filling inserted into the tank car.

Prior art

DETAILED DESCRIPTION OF DRAWINGS

Broadly, this invention relates to a hose fitting for filling tank cars such as railroad hoppers with pellet like particles, grain, sugar, powders and plastic or chemical pellets, or other particulate matter for example. Trucks transport a load of pellets to a railroad car through a hose connecting the two. The load is transferred to the hopper by compressed air. The hose fitting of this invention facilitates the insertion of a hose into an opening within the top of the tank car by comprising removable extensions that can be coupled to the main body of the hose fitting after the hose fitting is inserted into the top of the tank car. The extensions can remain connected to the main body of the hose fitting by connecting wires even when uncoupled from the main body. In this way, the extensions are easier to handle by the loader and do not get lost. When the compressor is turned on, the hose fitting with its extensions disperses pellet-like particles more evenly throughout the tank car or hopper then a hose without the t-shaped pipe fitting thereby avoiding uneven mounding and empty space within the tank car. Advantageously, the hose fitting of the present invention substantially stops the high pressure filling action when the pellet-like particles reach the top of the hose fitting so that pellets do not fly out of opening and are not lost to the environment.

Figure 1:
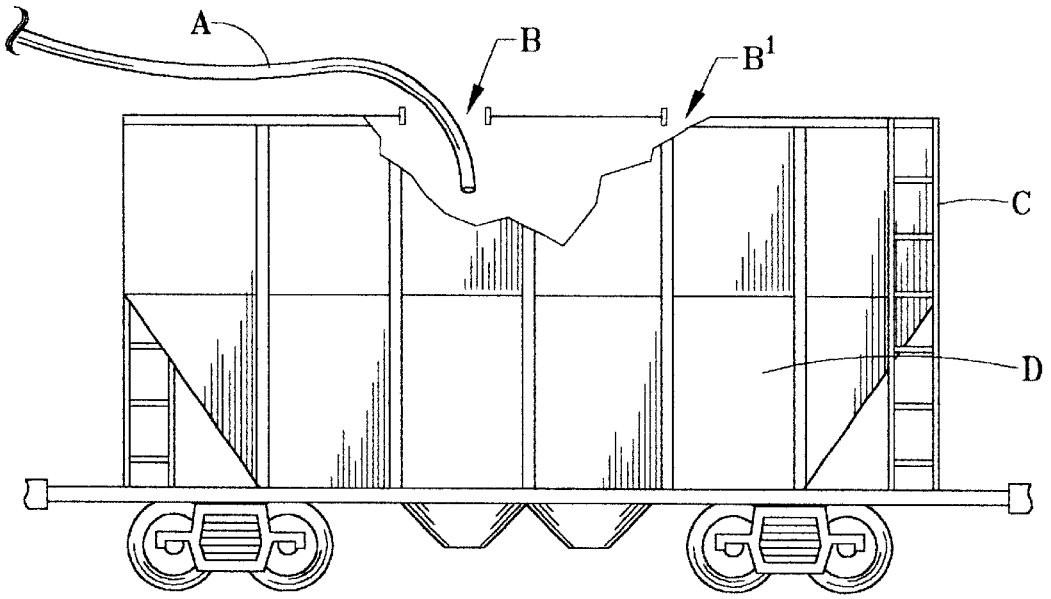
FIG. 1 (PRIOR ART)
Figure 2:
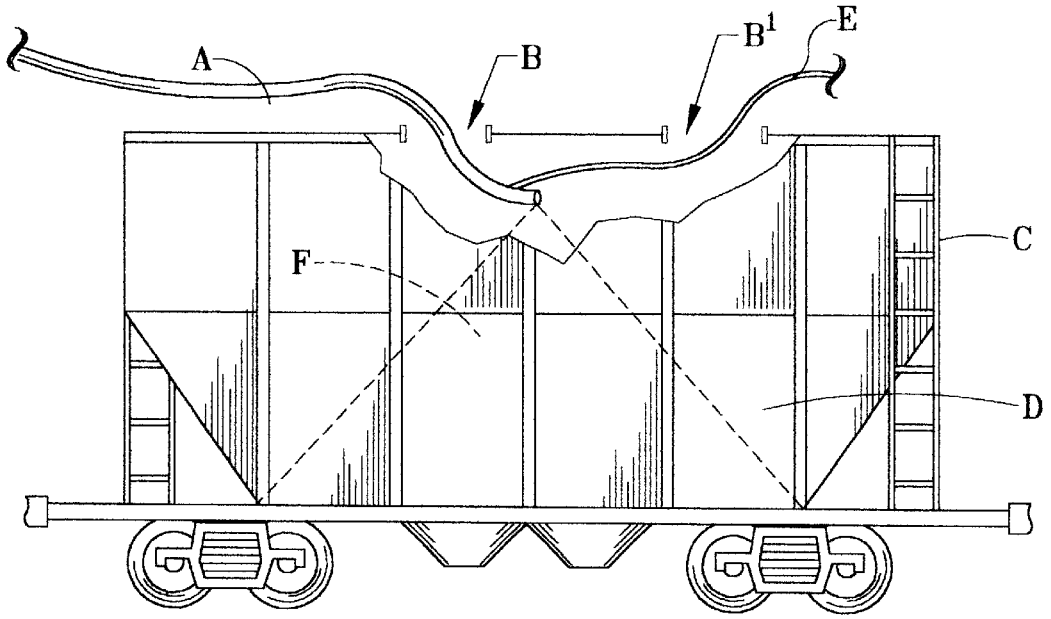
FIG. 2 (PRIOR ART)
FIG. 2 is a sectional view of a tank car with a rope attached to a hose for filling.
Figure 3:
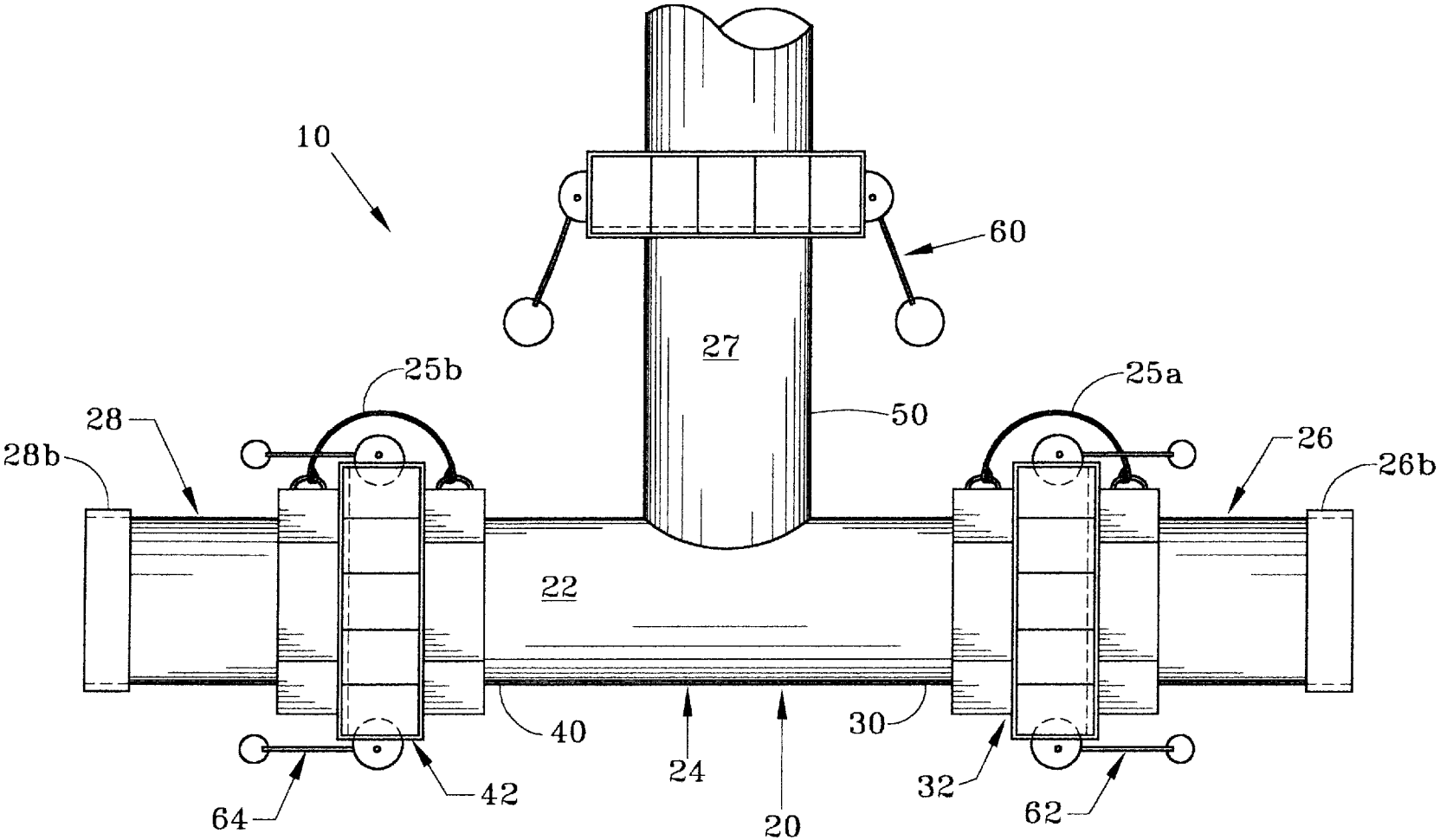
FIG. 3 is the t-shaped pipe of the present invention.
Figure 4:
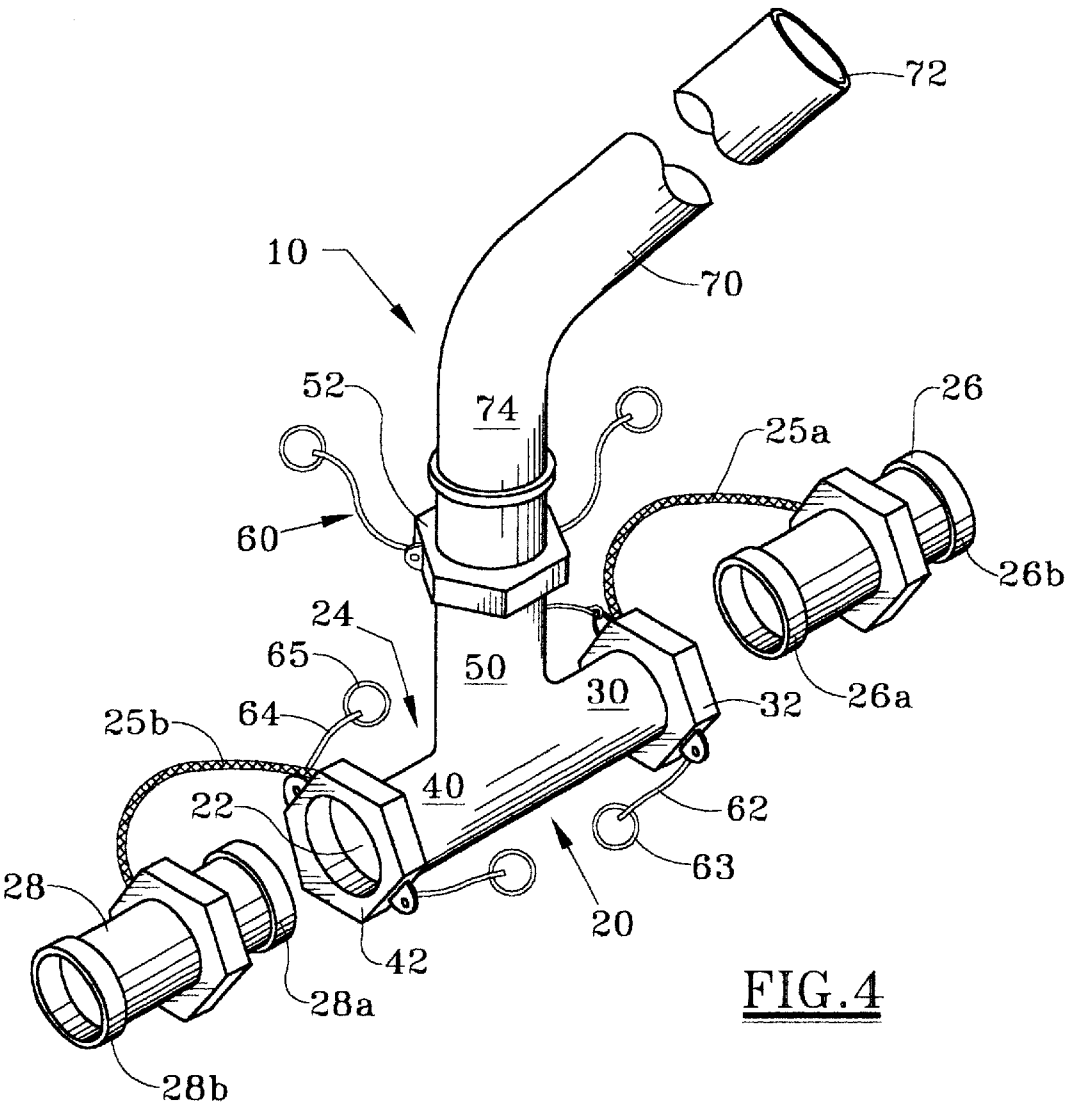
FIG. 4 is the t-shaped pipe with first and second extensions.
Figure 5:
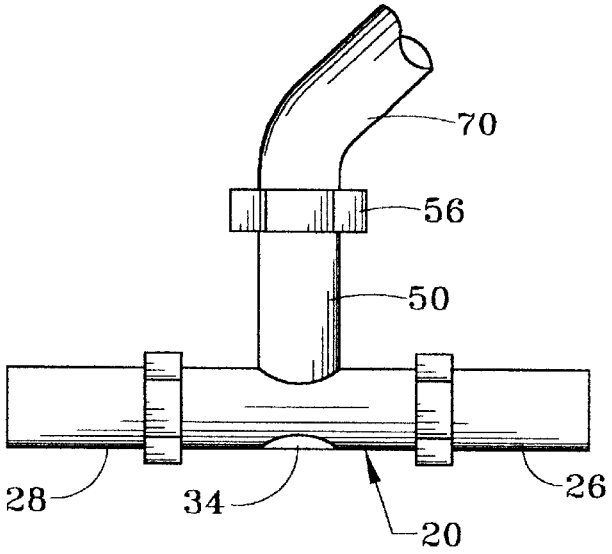
FIG. 5 is the hose fitting of the present invention illustrating an embodiment connected with a hose.

FIGS. 3 and 4 illustrate one preferred embodiment of the hose fitting for filling tank cars 10. As shown, the hose fitting 10 comprises a t-shaped pipe 20 defining a bore 22 therethrough. The t-shaped pipe comprises a body member 24 with one or more pairs of opposingly directed tubular legs 30, 40, and an intermediate leg 50 extending substantially perpendicular from the body member 24. The intermediate leg 50 is in fluid communication with the body member 24 and comprises an intermediate leg end 52 adapted to couple with a hose 70. Preferably, one or more tube extensions 26, 28 are connected to the t-shaped pipe 20 for coupling with the tubular legs 26, 28. Conveniently, each of the one or more tube extensions 26, 28 can be connected to one of the tubular legs 30, 40 by a connecting wire 25*a*, 25*b*. Because of the connecting wires 25*a*, 25*b*, the tube extensions 26, 28 remain connected to the tubular legs 30, 40 when the tube extensions 26, 28 are uncoupled from the tubular legs 30,40. Having the tube extensions 26, 28 connected to the t-shaped pipe 20 facilitates carrying and coupling of the extensions 26, 28 onto the tubular legs 30, 40. Also, it is easier to insert the hose fitting 10 into the opening 110, 120, 130 with only one extension 26 coupled onto it 10.

Preferably, each of the one or more pairs of legs 30, 40 comprises a first leg 30 and a second leg 40. The first leg 30 has a first leg end 32 and the second leg 40 has a second leg end 42. The first leg end 32 and the second leg end 42 are adapted to couple with the one or more tube extensions 26, 28. The preferred hose fitting 10 comprises a first tube extension 26 for detachably coupling to the first leg end 32 and a second tube extension 28 for detachably coupling to the second leg end 42 so that a fluid conduit 22 is provided therethrough when the first and second tube extensions 26, 28 are coupled to the first and second leg ends 32, 42. The tube extensions 26, 28 can be coupled to the first and second leg ends 32, 42 by lock-on, quick release safety couplers 62, 64.

In one embodiment, the lock-on, quick release safety couplers 62, 64 are cam and groove type couplers 62, 64. Cam and groove type couplers are known in the industry and provide a tight fitting that reduces spillage and leakage from the connections. The cam and groove couplers 62, 64 are integral with the first and second leg ends 32, 42 respectively and manufactured to provide smooth inner walls within the tubing of the t-shaped pipe 20. When loading a tank car, pellets move at high speeds through the hose and hose fitting. Precautions are required to prevent heat build up, especially for pellets that have low heat tolerance. Smooth, integral walls are required to reduce any heat caused by the friction of the pellets moving through the tubing 10. The first and second leg ends or female ends 32, 42 receive the male ends 26*a*, 28*a* of the first and second extension. Each male end 26*a*, 28*a* has a groove so that the cams of the female ends lock into the grooves of the male end when the latch 63, 65 is hitched.

The first extension 26 is connected to the first leg 30 end by a first connecting wire 25*a* and a second extension 28 is connected to the second leg end 40 by a second connecting wire 25*b*, so that the first extension 26 and the second extension 28 remain attached to the body member 24 by the first and second wires 25*a*, 25*b* when the first extension 26 is uncoupled from the first end 30 and the second extension 28 is uncoupled from the second end 40. Preferably, the first connecting wire 25*a* and the second connecting wire 25*b* comprise polyvinyl coated cable.

In a more preferred embodiment, the body member further comprises a cone-shape projection 34 extending into the bore 22 opposite the intermediate leg 50. When pellets 80 enter the hose fitting 10 under pressure, the pellets 80 can bounce off the projection and can be dispersed evenly to the first and second legs of the t-shaped pipe 30, 40.

The hose fitting 10 of one preferred embodiment attaches to a hose 70 that can be connected to a truck containing pellet like particles, such as grain, sugar, powders and plastic or chemical pellets, or other particulate matter. The intermediate leg 50 comprises an intermediate end 52 having a snap fitting or lock on cam and groove coupler 60 adapted to coupling with a hose 70. Compressors on the truck provide high pressure air to drive the pellets from the truck to the tank car.

The hose fitting 10 of the preferred embodiment is preferably manufactured from aluminum although other metals or plastics can be used. The outer walls of the tubular extensions can have an elastomeric coating on the ends 26*b*, 28*b* opposite the coupling ends 26*a*, 26*b* to prevent damage to the roof and walls of the tank car while the hose fitting 10 is in use. The inner walls are preferably smooth to prevent excess friction as the pellets 80 move through it 10.

One preferred embodiment of the hose fitting for filling a tank car 10, as shown in FIG. 4, comprises the t-shaped pipe 20 as describe above attached to a hose 70 adapted to disperse pellet-like particles under pressure. The hose 70 comprises a truck end 72 and a t-shaped pipe end. The intermediate leg end 52 of the t-shaped pipe 20 is adapted to couple with the t-shaped pipe end of the hose 74. The type of hose 70 commonly used to load pellets into tank cars is manufactured from stainless steel. Stainless steel is required because it is able to withstand the high pressure used to blow the pellets from the truck (not shown) into the tank car 100, FIG. 6.

In another embodiment of the hose fitting for filling tank cars 10, the hose fitting comprises a t-shaped pipe 20 that defines a bore 22 therethrough. The t-shaped pipe 20 comprises a body member 24 with one or more pairs of opposingly directed legs 30, 40, and an intermediate leg 50 extending substantially perpendicular from the body member 24. The intermediate leg 50 can comprise an intermediate end 52 and each of the one or more pairs of legs 3040 comprises a first leg 32 and a second leg 42. The first leg 30 has a first end 32, the second leg 40 has a second end 42 and the first end 32 and the second end 42 are adapted to mate with one or more tube extensions 26, 28. A first tube extension 26 can be detachably mated to the first end 32 of the first leg and a second tube extension 28 can be detachably mated to the second end 42 of the second leg so that a fluid conduit 22 is formed therethrough;

The first extension 26 and the second extension 28 can be connected to the body member 24 by first and second connecting wires 25*a*, 25*b* so that the first extension 26 and the second extension 28 remain attached to the body member 24 when the extensions are uncoupled or detached from the body member 24. In this embodiment, a hose 70 is adapted to disperse pellet-like particles 80 under pressure, the hose 70 comprises a truck end 72 and a t-shaped pipe end 74. The intermediate end 52 is adapted to couple with the t-shaped pipe end of the hose 74.

Figure 6:
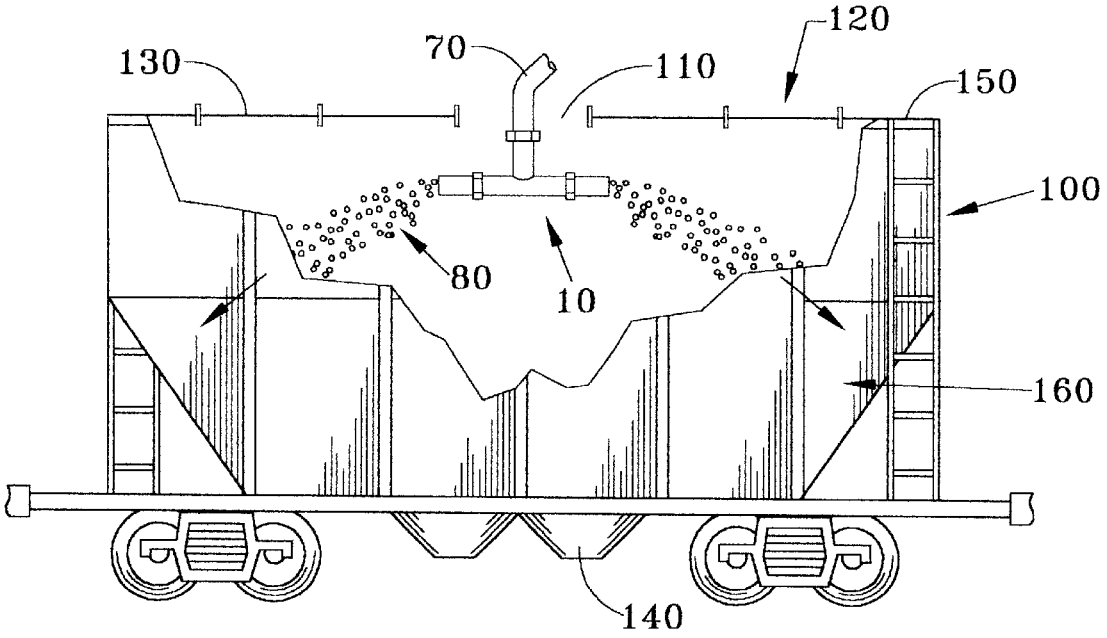
FIG. 6 is the hose fitting of the present invention inserted into a tank car.

FIG. 6 is a schematic illustrating a preferred method for filling tank cars with pellet-shaped particles using the hose fitting of this invention. One preferred method comprises transporting a hose fitting for filling tank cars 10 to the roof of a tank car 150 or railroad hopper that has one or more openings 110, 120, 130 for receiving materials. Commonly, hoppers have two or three hatched openings. The hose fitting 10 comprises a t-shaped pipe 20. As used in this method, the t-shaped pipe 20 comprises a body member 24 with one or more pairs of opposingly directed tubular legs 30, 40 extending therefrom. Each pair of opposingly directed legs 30,40 comprises a first leg 32,and a second leg 42. The body member 24 and tubular legs 30, 40 can comprises a first bore 22 extending therethrough, the body member 24 further comprises an intermediate leg 50 extending substantially perpendicular from the body member 24, the intermediate leg defining a second bore in fluid communication with the first bore.

The hose 70 to be transported to the roof of the tank car 100 can be carried up or, if the hose 70 is a heavy stainless steel hose, the truck driver or loader can attach a cord to one end of the hose 70 and pull the hose 70 up to the roof of the tank car 150. Preferably, the hose 70 is adapted to conduct pellet-like particles under pressure and comprises a truck end 72 for coupling the hose to the truck and a t-shaped pipe end 74 for safety lock coupling to the hose fitting or t-shaped pipe 20. The t-shaped pipe end 74 of the hose is coupled to the intermediate leg 50 of the t-shaped pipe 20 to form a hose fitting 10 and the truck end of the hose 72 is connected to the truck tank. The truck end of the hose 72 and the t-shaped pipe end 74 can further comprise quick release safety lock couplers for attaching the hose 70 to the t-shaped pipe 20.

After attachment to the hose, the t-shaped pipe 20 is introduced into an opening 110, 120, 130 in the roof of the tank car 150 and positioned inside the tank 160 of the tank car 100 approximately adjacent the roof 150 of the tank car. One advantage of the present invention 10 is that the hose fitting 10 with the attached hose 70 can be placed in the center opening 110 of a three-opening tank car or in either one of the openings in a two-opening tank car to evenly spread the pellets 80 while filling without mounding or leaving empty spaces within the tank car 100.

Pellet-like particles 80 from the truck are pumped by means of a compressor through the hose 70, through the bores 22 of the t-shaped pipe 20 and into tank car 100 to fill the tank car 100. Because the pellets 80 shoot out from the legs of the t-shaped pipe rather than the hose opening itself, the pellets 80 can bounce off the side of the tank car 100 and fill the car evenly without empty spaces. The pumping action substantially ceases when the pellet-like particles 80 reach the top of the bores of the t-shaped pipe 20 so that a minimum of pellets 80 are lost through the openings 110, 120, 130.

Preferably, each of the one or more pairs of legs 30, 40 of the t-shaped pipe 20 comprises a first leg 30 and a second leg 40, the first leg 30 having a first end 32, the second leg 40 having a second end 42, the first and the second ends 32, 42 adapted to couple with one or more tube extensions 26, 28, a first tube extension 26 detachably coupled to the first end of the first leg 32 and a second tube extension 28 detachably coupled to the second end of the second leg 42 so that a fluid conduit 22 is formed therethrough. The extensions 26, 28 enhance the filling process so that pellet-like particles bounce off the side walls of the tank car and fill the tank car in approximately even mounds thereby avoiding center pile up.

In one embodiment of this method, the first extension 26 can be connected to the first end 32 by a first connecting wire 25*a* and a second extension 28 can be connected to the second end 42 by a second connecting wire 25*b*, so that the first extension 26 and the second extension 28 remain connected to the body member 24 by the first and second wires 25*a*, 25*b* when the first extension 26 is uncoupled from the first end 32 and the second extension 28 is uncoupled from the second end 42.

Another preferred method for filling tank cars with pellet-shaped particles comprises transporting a t-shaped pipe 20 as describe above to the roof of a tank car 150, the tank car roof 150 having one or more openings for receiving materials. The t-shaped pipe 20 used in this method comprises one or more tube extensions 26, 28 for coupling with the tubular legs 30, 40. Each of the one or more tube extensions 26, 28 is connected to one of the tubular legs by a connecting wire 25*a*, 25*b* so that the tube extensions 26, 28 remain connected to the tubular legs 30, 40 when the tube extensions 26, 28 are uncoupled from the tubular legs 30, 40.

The trucker or loader transports a hose 70 to the top of the tank car 150, the hose 70 being adapted to conduct pellet-like particles 80 under pressure. Preferably, the hose 70 comprises a truck end 72 for coupling the hose 70 to the truck and a t-shaped pipe end 74. The t-shaped pipe end 74 of the hose is connected to the intermediate leg 50 of the t-shaped pipe to form a hose fitting 10. The truck end 72 of the hose is then connected to the truck tank.

One tube extension 26, 28 is coupled with one of the tubular legs 30, 40 and the t-shaped pipe 20 is introduced into an opening in the roof 110, 120, 130 of the tank car. The openings in the roof of the tank car 110,120, 130 are typically 29 inches in diameter. For ease of insertion, the length of the t-shaped pipe with one extension is approximately within a range of 27 to 28 and ½ inches. Once the t-shaped pipe 20 comprising one extension 26, 28 is inside the tank car 100, a second tube extension 26, 28 can be connected to a second tubular leg 30, 40 thereby extending the length of the t-shaped pipe to a range that is between approximately 30 inches to 33 inches. The dimensions of the hose fitting and its components can vary depending on the openings 110, 120,130 within the roof of the tank car. Variations of length and size to the hose fitting 10 and its components are within the scope of this invention.

The t-shaped pipe 20 with both of the tube extensions 26, 28 is positioned inside the tank of the tank car 160 approximately adjacent the roof of the tank car 150. Proximity to the inside top of the tank car 100 is desirable so that the pellets can fill the hopper with little or no empty spaces. Once the hose fitting 10 is positioned, the truck compressor is turned on and pellet-like particles are blown from the truck through hose, through the bores of the t-shaped pipe and into tank car to fill the tank car. If necessary, the loader can reposition the hose fitting 10 to facilitate the filling of the tank car to its maximum capacity. The pumping action substantially ceases when the pellet-like particles reach the top of the bores within the hose fitting. The loader will then turn off the compressor, remove the hose fitting 10 and seal the tank car.

The foregoing description is illustrative and explanatory of preferred embodiments of the invention, and variations in the size, shape, materials and other details will become apparent to those skilled in the art. It is intended that all such variations and modifications which fall within the scope or spirit of the appended claims be embraced thereby.

What is claimed is:

1. A hose fitting for filling tank cars with particulate matter comprising:

a t-shaped pipe defining a bore therethrough, the t-shaped pipe comprising a body member with at least one pairs of opposingly directed tubular legs, and an intermediate leg extending substantially perpendicular from the body member, the intermediate leg in fluid communication with the body member, the intermediate leg comprising an intermediate leg end adapted to couple with a hose; and at least one tube extension for coupling with the tubular legs, each of the at least one tube extensions connected to one of the tubular legs by a connecting wire so that the tube extensions remain connected to the tubular legs when the tube extensions are uncoupled from the tubular legs.

2. The hose fitting of claim 1 wherein each of the at lease one pair of legs comprises a first leg and a second leg, the first leg having a first leg end, the second leg having a second leg end, the first leg end and the second leg end adapted to couple with the one or more tube extensions.

3. The hose fitting of claim 1 wherein a first tube extension for detachably coupling to the first leg end and a second tube extension for detachably coupling to the second leg end so that a fluid conduit is provided therethrough when the first and second tube extensions are coupled to the first and second leg ends.

4. The hose fitting of claim 3 wherein the first extension is connected to the first leg end by a first connecting wire and a second extension is connected to the second leg end by a second connecting wire, so that the first extension and the second extension remain attached to the body member by the first and second wires when the first extension is uncoupled from the first end and the second extension is uncoupled from the second end.

5. The hose fitting of claim 4 wherein the first connecting wire and the second connecting wire comprise polyvinyl coated cable.

6. The hose fitting of claim 4 wherein the first end of the first leg and the second end of the second leg comprise lock-on safety couplers for coupling with the first and second extensions.

7. The hose fitting of claim 1 wherein the intermediate end comprises a snap fitting adapted to coupling with a hose.

8. The hose fitting of claim 1 wherein the body member further comprises a cone-shape projection extending into the bore opposite the intermediate leg.

9. A hose fitting for filling tank cars with particulate matter comprising:

a t-shaped pipe defining a bore therethrough, the t-shaped pipe comprising a body member with at least one pair of opposingly directed tubular legs, and an intermediate leg extending substantially perpendicular from the body member, the intermediate leg comprising an intermediate leg end adapted to couple with a hose;

at least one tube extension for coupling with the tubular legs, each of the at least one tube extensions connected to one of the tubular legs by a connecting wire so that the tube extensions remain connected to the tubular legs when the tube extensions are uncoupled thereto; and a hose adapted to disperse particulate matter under pressure, the hose comprising a truck end and a t-shaped pipe end, the intermediate end adapted to couple with the t-shaped pipe end of the hose.

10. A method for filling tank cars with particulate matter from a tank truck comprising:

(a) transporting a t-shaped pipe to the roof of a tank car, the tank car roof having at least one opening for receiving materials, the t-shaped pipe comprising a body member with at least one pair of opposingly directed tubular legs extending therefrom, each pair of opposingly directed legs comprising a first leg and a second leg, the body member and tubular legs comprising a first bore extending therethrough, the body member further comprising an intermediate leg extending substantially perpendicular from the body member, the intermediate leg defining a second bore in fluid communication with the first bore;

(b) transporting a hose to the top of the tank car, the hose adapted to conduct particulate matter under pressure, the hose comprising a truck end for coupling the hose to the truck and a t-shaped pipe end;

(c) connecting the t-shaped pipe end of the hose to the intermediate leg of the t-shaped pipe to form a hose fitting and connecting the truck end of the hose to the truck tank;

(d) introducing the t-shaped pipe into an opening in the roof of the tank car;

(e) positioning the t-shaped pipe inside the tank of the tank car approximately adjacent the roof of the tank car;

(f) pumping particulate matter from the truck through hose, through the bores of the t-shaped pipe and into tank car to fill the tank car;

wherein the pumping action of step (f) substantially ceases when the particulate matter reach the top of the bores.

11. The method of claim of claim 10 wherein the truck end and the t-shaped pipe end comprise quick release couplers.

12. The method of claim 10 wherein each of the at least one pair of legs comprises a first leg and a second leg, the first leg having a first end, the second leg having a second end, the first and the second end adapted to couple with one or more tube extensions, a first tube extension detachably coupled to the first end of the first leg and a second tube extension detachably coupled to the second end of the second leg so that a fluid conduit is formed therethrough so that particulate matter fill the tank car in approximately even mounds thereby avoiding center pile up.

13. The method of claim 10 wherein the first extension is connected to the first end by a first connecting wire and a second extension is connected to the second end by a second connecting wire, so that the first extension and the second extension remain connected to the body member by the first and second wires when the first extension is uncoupled from the first end and the second extension is uncoupled from the second end.

14. The method of claim 10 wherein the third end of the intermediate leg comprises a snap fitting for mating with the hose.

15. The method of claim 10 wherein the first end of the first leg and the second end of the second leg comprise lock-on safety couplers for locking with the first and second extensions.

16. The method of claim 10 wherein the body member further comprises a cone-shape projection extending into the bore opposite the intermediate leg.

17. A hose fitting for filling tank cars with particulate matter comprising:

a t-shaped pipe defining a bore therethrough, the t-shaped pipe comprising a body member with at least one pair of opposingly directed legs, and an intermediate leg extending substantially perpendicular from the body member, the intermediate leg comprising an intermediate end, each of the at least one pairs of legs comprising a first leg and a second leg, the first leg having a first end, the second leg having a second end, the first end and the second end adapted to mate with at least one tube extension, a first tube extension detachably mated to the first end of the first leg and a second tube extension detachably mated to the second end of the second leg so that a fluid conduit is formed therethrough;

the first extension connected to the first end by a first connecting wire and a second extension connected to the second end by a second connecting wire, so that the first extension and the second extension remain attached to the body member by the first and second wires when the first extension is detached from the first end and the second extension is detached from the second end; and a hose adapted to disperse particulate matter under pressure, the hose comprising a truck end and a t-shaped pipe end, the intermediate end adapted to couple with the t-shaped pipe end of the hose.

18. A method for filling tank cars with particulate matter comprising:

(a) transporting a t-shaped pipe to the roof of a tank car, the tank car roof having at least one opening for receiving materials, the t-shaped pipe comprising a body member with at least one pair of opposingly directed tubular legs extending therefrom, each pair of opposingly directed legs comprising a first leg and a second leg, the t-shaped pipe further comprising at least one tube extension for coupling with the tubular legs, each of the at least one tube extension connected to one of the tubular legs by a connecting wire so that the tube extensions remain connected to the tubular legs when the tube extensions are uncoupled from the tubular legs;

(b) transporting a hose to the top of the tank car, the hose adapted to conduct particulate matter under pressure, the hose comprising a truck end for coupling the hose to the truck and a t-shaped pipe end;

(c) connecting the t-shaped pipe end of the hose to the intermediate leg of the t-shaped pipe to form a hose fitting and connecting the truck end of the hose to the truck tank;

(d) connecting one tube extension to one of the tubular legs;

(e) introducing the t-shaped pipe into an opening in the roof of the tank car;

(f) connecting a second tube extension to a second tubular leg;

(g) positioning the t-shaped pipe with tube extensions inside the tank of the tank car approximately adjacent the roof of the tank car;

(h) pumping particulate matter from the truck through hose, through the bores of the t-shaped pipe and into tank car to fill the tank car;

wherein the pumping action of step (h) substantially ceases when the particulate matter reaches the top of the bores.

* * * * *